US006656006B2

(12) United States Patent
Yamamuro et al.

(10) Patent No.: US 6,656,006 B2
(45) Date of Patent: Dec. 2, 2003

(54) FLUORESCENT LAMP AND METHOD FOR PRODUCTION

(75) Inventors: Yohei Yamamuro, San Diego, CA (US); Thomas Louchard, Coronado, CA (US); Thomas J. Roetker, San Diego, CA (US)

(73) Assignee: Hewlett-Packard Development Company, LP., Houston, TX (US)

( * ) Notice: Subject to any disclaimer, the term of this patent is extended or adjusted under 35 U.S.C. 154(b) by 0 days.

(21) Appl. No.: 10/062,635

(22) Filed: Jan. 31, 2002

(65) Prior Publication Data

US 2003/0143913 A1 Jul. 31, 2003

(51) Int. Cl.[7] ..... H01J 9/395
(52) U.S. Cl. ..... 445/9
(58) Field of Search ..... 445/3, 21, 53, 445/38, 70, 73, 9, 26; 313/637–643

(56) References Cited

U.S. PATENT DOCUMENTS 4,001,623 A * 1/1977 Howles et al. ..... 313/634
4,494,042 A 1/1985 Roche
4,506,189 A 3/1985 Nolan et al.
4,507,332 A 3/1985 Nolan et al.
5,022,882 A * 6/1991 White et al. ..... 445/21
5,026,311 A * 6/1991 White ..... 445/26
5,029,311 A 7/1991 Brandkamp et al.
5,211,595 A * 5/1993 Kowalczyk et al. ..... 445/26
5,520,560 A 5/1996 Shiabel et al.
5,907,742 A 5/1999 Johnson et al.
6,174,213 B1 1/2001 Paz de Araujo et al.
6,188,185 B1 2/2001 Ter-Hovhannisian et al.

OTHER PUBLICATIONS

John H. Kahl, "Cold–Cathode Fluorescent Lamps (CCFL's) A History and Overview," Oct. 1997, JKL Components Corporation, Pacoima, California, USA.

* cited by examiner

*Primary Examiner*—Renee Luebke
*Assistant Examiner*—Felix O. Figueroa

(57) ABSTRACT

A method and lamp produced by using this method for evenly disbursing mercury and other lamp compounds throughout the entire length of assembled fluorescent lamps by uniformly and thoroughly heating each lamp's sealed chamber containing these materials to a temperature high enough to vaporize the mercury therein.

16 Claims, 5 Drawing Sheets

FLUORESCENT LAMP AND METHOD FOR PRODUCTION

TECHNICAL FIELD

This invention relates to a manufacturing method and device for producing fluorescent lamps and such lamps produced thereby.

BACKGROUND OF THE INVENTION

Fluorescent lamps are widely used in a variety of applications including image scanners and copy machines. In many of these applications, it is desirable for the fluorescent lamps to light-up, or stabilize their light levels, quickly and consistently, even when they have not operated for extended periods of time. For example. many owners of image scanners do not use them frequently. However, these owners expect their scanners to consistently and quickly operate when needed with minimal warm-up time.

Despite the benefits offered by fluorescent lamps and the desirability for them to light quickly, their basic structure typically requires some warm-up time before they are able to produce the desired levels of light. In general, a typical fluorescent lamp generates light by energizing a pair of spaced-apart electrodes positioned within a phosphor-coated sealed tube of a vapor containing mercury. Electrons from one of the electrodes pass through the vapor to the other electrode, thereby exciting the mercury and causing it to emit ultra-violet light. The ultra-violet light then interacts with the phospher coating to produce visible light. A very large number of these interactions must take place before a usable level of visible light is generated.

Residual heat generated by these interactions facilitates new interactions and thereby helps sustain the continued operation of the lamp. However, a lamp that has not been used for an extended period must typically generate a sufficient level of heat before a sufficient number of electron/mercury and ultra-violet/phosphor interactions are achieved to produce meaningful visible light. This time is often called the warm-up time of the fluorescent bulb.

In general, there are two types of electrodes used in fluorescent bulbs: hot-cathode electrodes and cold-cathode electrodes. Hot-cathode electrodes include a resistive filament, which like a filament in an incandescent bulb, is heated by current passing through it. This heat facilitates operation of the lamp. However, these hot-cathode filaments are fragile and require particularly complex electrical circuitry to operate effectively in this scanning environment.

Cold-cathode electrodes do not rely on additional means for generating heat besides that created by the electrical discharge through the fluorescent tube. As a result, they are typically easier to miniaturize because of the simplified electrode and reduced complexity of their driving electronics. Moreover, because they lack a fragile filament, they are more durable and usually last longer than hot-cathode fluorescent bulbs. Accordingly, cold-cathode electrodes in fluorescent lamps, which are commonly known as cold-cathode fluorescent lamps ("CCFL"), are typically used in miniaturized applications such as in desktop scanners. However, because CCFL lamps rely exclusively on the heat generated by the electrical discharge through the fluorescent tube, they typically have longer warm-up times than similarly sized hot-cathode fluorescent lamps.

A variety of devices and processes have been developed in an attempt to improve the warm-up time of fluorescent lamps. For example, U.S. Pat. No. 5,907,742 to Johnson et al. teaches using a variety of the system's electronics to provide high voltage overdrive during early lamp warm-up, closed loop light level control, and periodic lamp warming during standby, to quickly warm-up and maintain the lamp's heat and thereby decrease its warm-up time during use. In addition, U.S. Pat. No. 5,029,311 to Brandkamp et al. physically wraps the fluorescent lamp in a heater blanket in an attempt to maintain the same constant lamp temperature profile during both the lamp operation cycle and during standby. While these devices improve lamp warm-up time, the increased electronics and/or hardware also increase the complexity and expense of the products incorporating them, as well as increasing power consumption.

There have also been attempts to improve the specific construction and methods for manufacturing fluorescent lamps themselves. For example, U.S. Pat. No. 6,174,213 to Paz de Araujo et al. teaches a specialized method for applying a thin-film layer of conductive metal oxide to the inner lamp wall surface. In particular, a solution of metal precursor compound is allowed to distribute itself around the inner surface of the lamp before a solid metal oxide layer is formed by heating the liquid metal precursor. These additional processes increase the cost of manufacturing these lamps.

Similarly, other ways for releasing mercury vapor within a sealed lamp during the manufacturing process have also been considered. For example. U.S. Pat. No. 5,520,560 to Schiabel et al. heats a solid compound containing mercury to a temperature in excess of 500° C. to thereby vaporize the mercury in the solid compound and release it within the sealed chamber. Despite these improvements, fluorescent lamps, and in particular CCFL lamps, still tend to have long warm-up times. Moreover, similar lamps manufactured using the same techniques often have a large variability in their individual warm-up times.

SUMMARY OF THE INVENTION

The invention is a method for producing a fluorescent lamp, and the lamp thereby produced using the method, that includes assembling the fluorescent lamp having a sealed chamber containing mercury and then uniformly heating the chamber along its length to a temperature above the vaporization temperature of the mercury to vaporize the mercury and thereby evenly disburse the mercury within the chamber.

DETAILED DESCRIPTION

Figure 1:
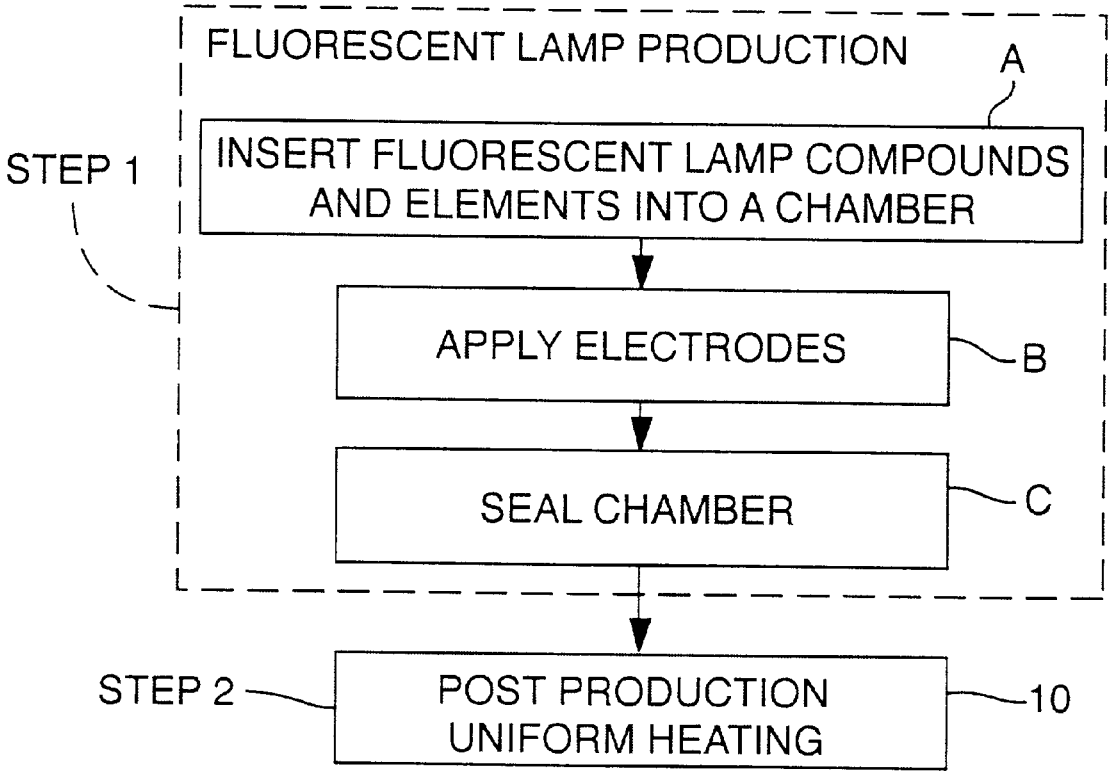
FIG. 1 is a block diagram of a process for producing fluorescent lamps in accordance with an embodiment of the present invention.

A one-time, fluorescent lamp post-assembly heating process 10 for reducing the warm-up time and variability in warm-up times among a plurality of similar fluorescent lamps 12 (FIG. 7) is shown schematically in FIG. 1. An exemplar rack 14 and related structures used with this method is disclosed in FIGS. 2–7.

A. Post-Assembly Uniform Heating

Figure 2:
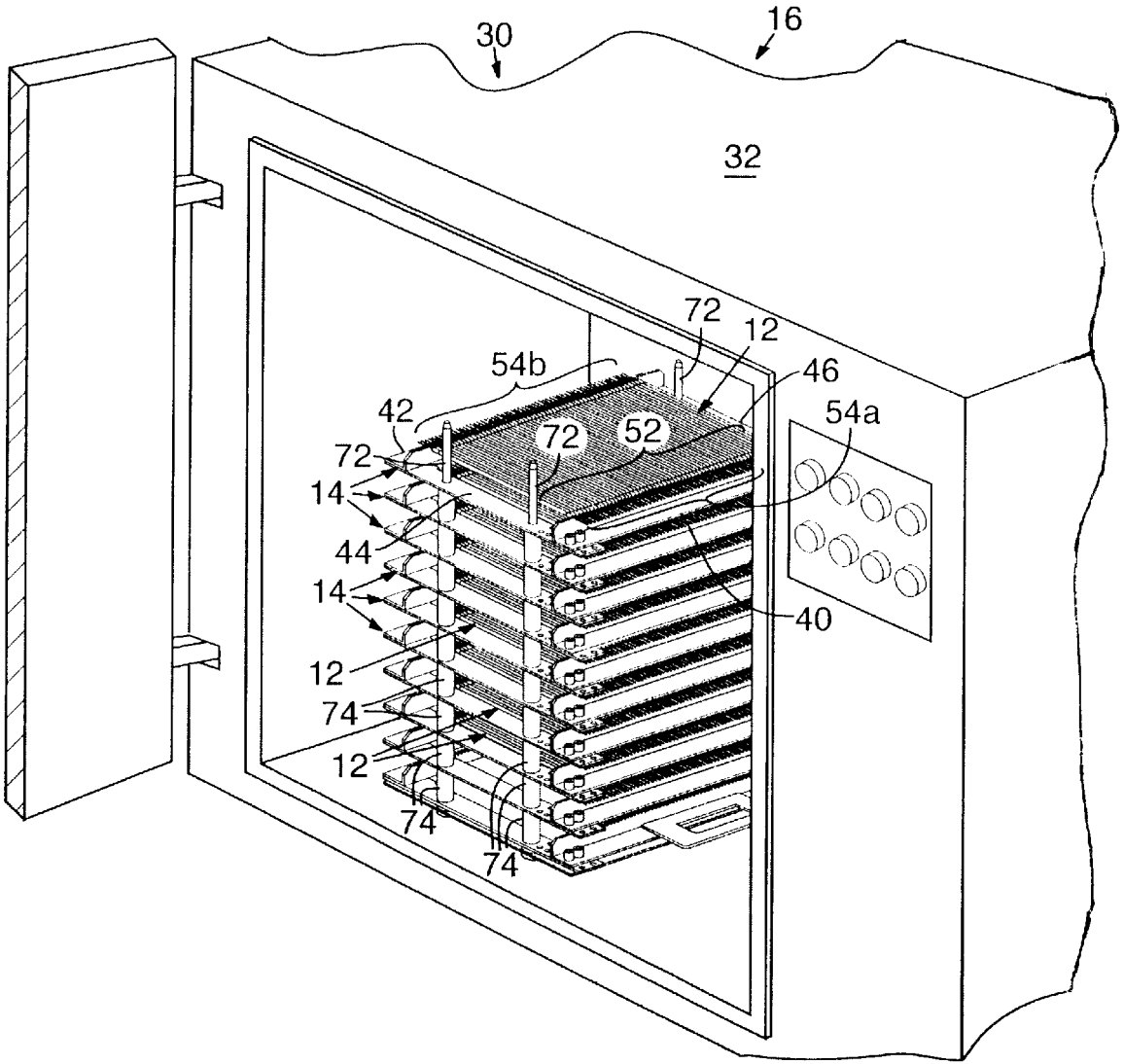
FIG. 2 is an isometric view of a batch, post-assembly, heating device using a plurality of racks each containing assembled fluorescent lamps in accordance with an embodiment of the present invention.
Figure 3:
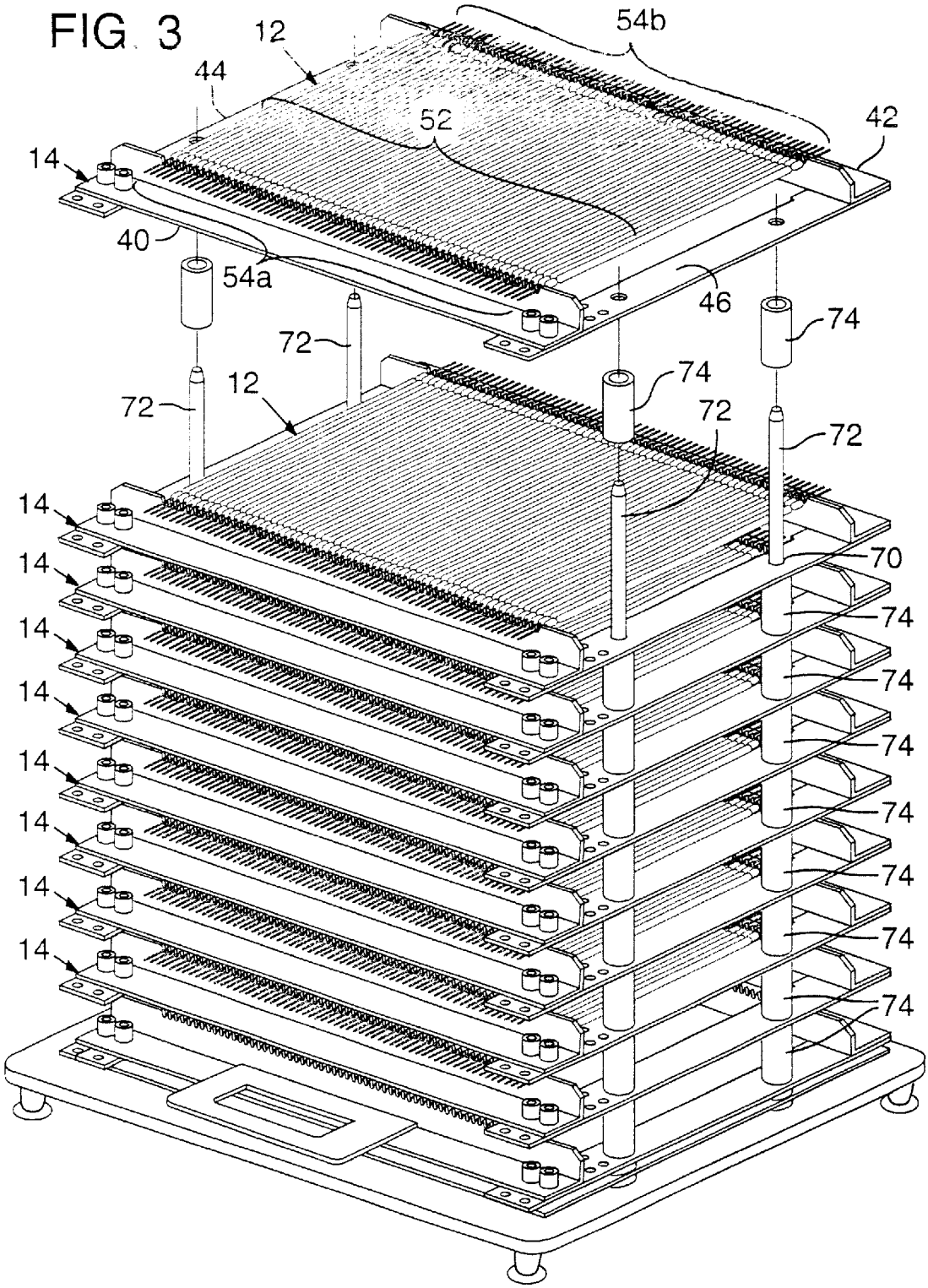
FIG. 3 is an exploded, isometric view of the plurality of racks of FIG. 2.
Figure 8:
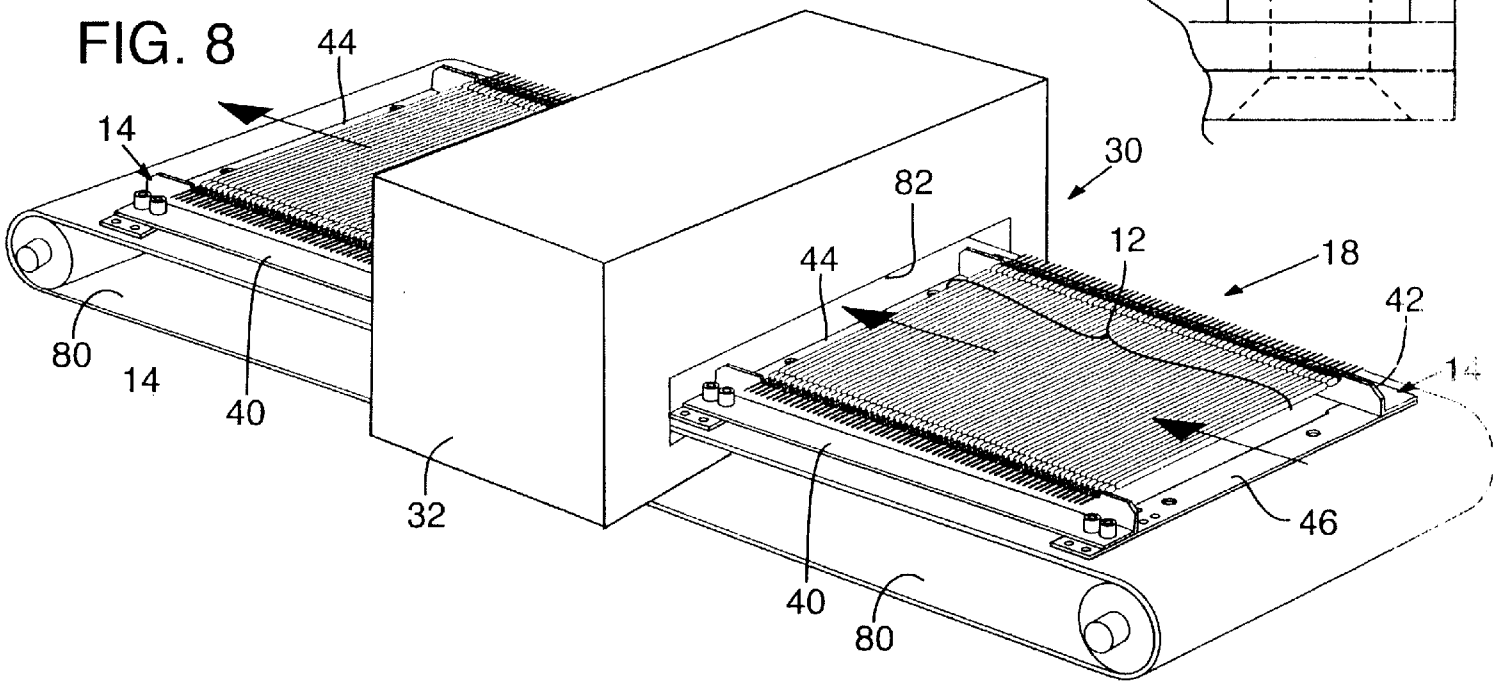
FIG. 8 is an isometric view of a continuous, post-assembly, heating device using a continuous rack containing a plurality of assembled fluorescent lamps therein in accordance with an alternative embodiment of the present invention.

Referring to FIG. 1, a fluorescent lamp 12 initially assembled according to conventional methods (Step 1). Then, the assembled fluorescent lamp is subjected to a uniform, post-production heating step (Step 2). Experiments and testing reveal that post-production heating reduces the warm-up time of the fluorescent lamp 12 (FIG. 3). In a preferred embodiment, a plurality of assembled fluorescent lamps 12 are uniformly heated either in a batch process 16 as shown in FIG. 2, or through a continuous process 18 as shown in FIG. 8.

As shown in FIG. 1, conventional fluorescent lamp production includes several steps that generally include a step of inserting appropriate mixtures of fluorescent lamp compounds and elements, such as mercury into a chamber, which is usually a glass tube (Step A). Appropriate electrodes, which may either be cold-cathodes, or hot-cathodes, are then usually attached to the ends of the glass tube (Step B), and the chamber is sealed (Step C).

During this process, mercury and other compounds may be dispersed within the chamber using conventional methods. For example, a container of liquid mercury may be inserted into the chamber and shaken to disperse it within the chamber. Alternatively, a solid disk containing mercury can be heated to extremely high temperatures to vaporize it, and thereby distribute the mercury within the chamber. However, these processes frequently lead to uneven distribution of the mercury. It is believed that this uneven dispersal of mercury within each lamp increases the warm-up time of the lamps, and leads to inconsistent performance between lamps, even when manufactured in the same batch.

Moreover, since different lamps using the same manufacturing processes are usually subjected to different levels of shaking and/or heat distribution, there is a wide variability m warm-up times among a group of lamps that have been subjected to the same general processes. For example, some manufacturers use brackets and other holders that touch the exterior surface of the fluorescent lamp chambers during these dispersal processes. These points of contact affect the temperature of the chambers at those locations, thereby creating temperature gradients along each lamp. These temperature gradients cause uneven mercury dispersal among the lamps within the group.

Similarly, some manufacturers heat the chambers while the chambers are aligned substantially vertical. It is believed that heating a substantially vertical chamber creates a temperature gradient within the lamp as the heat of the cooling chamber rises. This rising heat allows the lower portion of the lamp to heat-up slower and cool quicker than the upper portion of the chamber, thereby unevenly heating the chamber.

Our experimental data suggests that thorough, uniform and constant heating of sealed, assembled fluorescent lamps to a temperature high enough to vaporize the mercury therein, but not so high so as to melt other components of the lamp, leads to uniform and faster start-up time of the fluorescent lamps subjected to this process. For example, an effective post-production heating temperature has been achieved when the sealed chambers containing the mercury reach a uniform temperature therein at or above 225° C. and less than or equal to 500° C. for at least 5 minutes. More preferably, the desired range of temperatures was found to be between 240° C. and 275° C., and optimal results were obtained during testing at approximately 250° C.

It is believed that this post-production heating process (Step 2, FIG. 1) has the effect of correcting uneven mercury dispersal arising during the production process of a particular lamp within a batch, thereby essentially normalizing all the lamps in a given batch. In addition to the improved average warm-up time of lamps within the batch, this normalizing effect also reduces the overall variability in warm-up times among the lamps in the batch.

Moreover, a plurality of lamps may be processed, either as a batch, or though a continuous heating process, without compromising our uniform heating goals. Exemplar batch and continuous heating processes and structures are discussed in greater detail below to illustrate these principles and concepts.

B. Batch Process Post-Assembly Heating Structures

Figure 7:
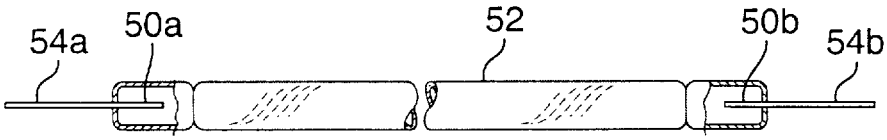
FIG. 7 is an enlarged, isometric view of an exemplar fluorescent lamp in accordance with an embodiment of the present invention.

Referred to FIGS. 2–6, a batch process 16 post-assembly heating structure 30 is disclosed. Preferably, the fluorescent lamps 12, one of which is shown in detail in FIG. 7, are uniformly heated in a convection oven 32 such that none of the fluorescent lamps 12 touch each other and there is unblocked airflow around all lamp chambers during the post-production heating step (Step 2, FIG. 1). More preferably, the fluorescent lamps 12 are also aligned substantially horizontal during the post-production heating step (Step 2, FIG. 1).

It is believed that such horizontal alignment allows for even heating and cooling of the lamp chambers along their entire longitudinal length. The lamps are also easier to handle in a manufacturing environment when they are positioned substantially horizontal.

Figure 4:
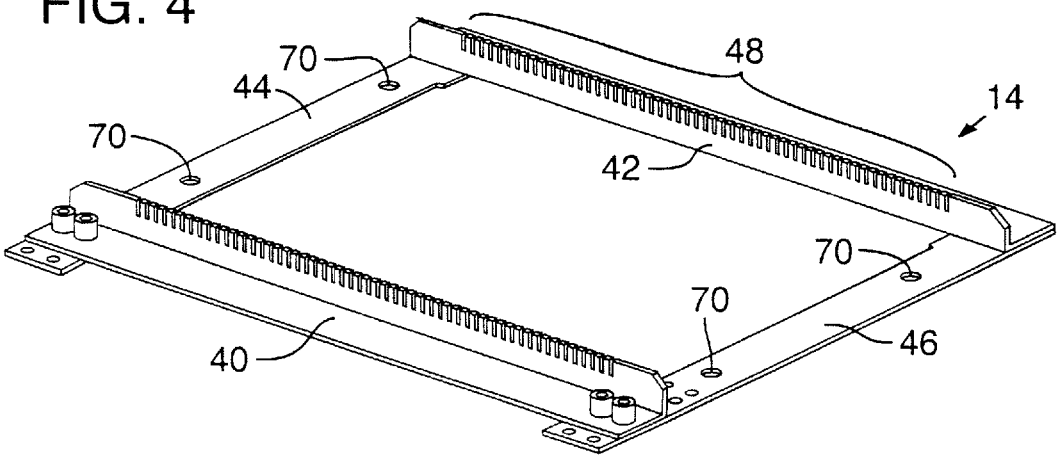
FIG. 4 is an isometric view of a rack of FIG. 2.
Figure 5:
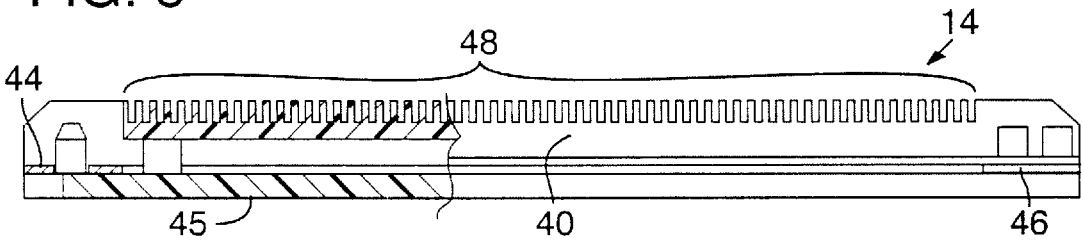
FIG. 5 is a side view of the rack of FIG. 4.

One structure for providing such uniform heating is a heating rack 14 shown in FIGS. 4 and 5. Preferably, the heating rack 14 has a left side 40 and right side 42, joined together by forward and rearward support members 44, 46, respectively. The left and right sides 40, 42 each include a plurality of lamp holding members, such as notches 48 defined thereby. The notches 48 are spaced apart from each other and aligned such that a fluorescent lamp 12 extends between the left and right sides 40, 42 of the rack 14, substantially transverse to the left and right sides 40, 42.

Figure 6:
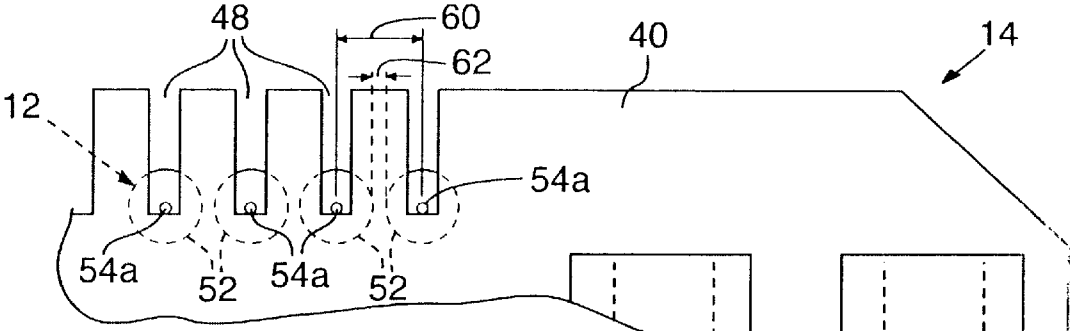
FIG. 6 is an enlarged, fragmentary side view of a rack having a plurality of fluorescent lamps thereon taken along lines 6—6 of FIG. 2.

Preferably, the fluorescent lamps 12 to be heated are cold-cathode fluorescent lamps ("CCFL"), each having a pair of electrodes 50*a*, 50*b* (FIG. 7) separated by a sealed, elongate, glass chamber 52 containing mercury and related-compounds therein. A lead wire 54*a*, 54*b* extends from each electrode 50*a*, 50*b* as best shown in FIGS. 3 and 7. As best shown in FIG. 6, each notch 48 is sized to receive a lead wire 54*a*, 54*b* from a fluorescent lamp 12 such that each lamp straddles the rack supported only by its lead wires 54*a*, 54*b* received within the notches 48. Preferably, no part of the elongate glass chamber 52 physically touches the rack 14. Moreover, the notches 48 are spaced apart from each other by a defined distance 60 such that the glass chambers 52 of adjacent lamps within the rack 14 do not contact each other and a small gap 62 is formed therebetween allowing air to pass freely around the entire circumference and length of each elongate glass chamber 52 received within the rack 14.

Accordingly, the elongate glass chambers 52 containing the mercury are uniformly heated by convection heat, and virtually no heat is conducted from the rack 14 to the glass chambers 52.

As best shown in FIG. 3, each rack 14 preferably includes mounting hole 70 for receiving mounting pins 72 therethrough. A plurality of racks 14 can be stacked one on top of the other, and stabilized by the mounting pins 72. Spacers 74, operably secured to the mounting pins 72, extend between adjacent racks 14, thereby spacing them apart from each other. Accordingly, as best shown in FIG. 2, multiple layers of racks 14, with each rack containing a plurality of sealed, assembled fluorescent lamps 12 therein, can be heated as a batch within a conventional industrial convection oven 32 while still maintaining uniform heating of each fluorescent lamp 12 within each rack 14. Other fixtures may be used to secure the lamps in such a preferred orientation depending on the particular oven, lamp size, loading equipment, etc. employed.

Our experimental tests reveal several benefits of this illustrated process. For example, a plurality of sealed, and fully assembled CCFL lamps, each lamp being 250 millimeters long, having an elongate glass chamber with a 2.5 millimeter outer diameter, and filled with approximately 1.5 milligrams of liquid mercury, were heated in a convection oven while mounted to racks such that the centers of the lamps were spaced apart from each other by 5 millimeters as shown in FIGS. 2–6. The temperature of the chambers achieved 250° C. for at least 5 minutes, and the lamps were then allowed to cool before being removed from the rack 14.

Lamp warm-up time is defined as the time in seconds for a lamp to reach a state whereby the percent error of lamp light output measured across the length of the lamp by a dye-based color charge coupled device every 2 milliseconds is less than 4%. A group of baseline lamps constructed using earlier methods were selected from a batch of assembled lamps. These baseline lamps had an average warm-up time of 27.3 seconds with a variance of 43.7 seconds. However, lamps from the batch of lamps that were subjected to the post-production heating process 10 as previously described had a 19.5 second average lamp warm-up time with only a 5.2 second variance. Accordingly, the average lamp warm-up time was reduced by nearly a third, and the variance was reduced by nearly 90%. These results reveal that both the average lamp warm-up time and variance were significantly improved by post-production heating.

Our additional testing also suggests that the particular heat-up and cool-down profiles used to raise and lower the lamps' temperature during this process 10 do not appear to significantly impact these improved warm-up time or variance characteristics. Moreover, the benefits associated with the post-production heating process do not appear to degrade substantially over the useful life of the lamps.

C. Continuous Process Post-Assembly Heating

Referring to FIG. 8, a continuous process 18 post-assembly heating structure 30' is disclosed. In this embodiment, the rack 14 of the previous embodiment containing a plurality of assembled, fluorescent lamps 12, which may be positioned thereon as previously described, is placed on a continuous loop 80 leading through a convection oven 32 or the like. Preferably, the fluorescent lamps 12 in the rack 14 are aligned substantially parallel to the oven's opening 82 as shown so that all portions of each lamp enter and exit the oven 32 substantially at the same time. Accordingly, even heating is imparted along the entire longitudinal length of each lamp as each lamp passes through the oven 32.

The oven 32 temperature and speed of the continuous loop 80 are controlled so as to maintain each fluorescent lamp 12 at a desired temperature within the oven 32 for a desired time. Accordingly, each fluorescent lamp 12 is evenly and uniformly heated, thereby producing the same benefits as the previous embodiment, but also allowing a continuous flow of fluorescent lamps 12 though the oven 32, thereby allowing improved efficiency of the process.

D. Alternative Embodiments

Having here described preferred embodiments of the present invention, it is anticipated that other modifications may be made thereto within the scope of the invention by individuals skilled in the art. For example, the post-production heating temperatures and times may be modified for a particular lamp design and mercury compound. Thus, although preferred and alternative embodiments of the present invention have been described, it will be appreciated that the spirit and scope of the invention is not limited to those embodiments, but extend to the various modifications and equivalents as defined in the appended claims.

What is claimed is:

1. A method of producing a fluorescent lamp, said method comprising: inserting mercury into a chamber having a length, said chamber containing phosphor;

securing electrodes to said chamber;

sealing said chamber; and uniformly heating said chamber along said length of said chamber to a temperature above a vaporization temperature of said mercury for a defined period to vaporize said mercury and thereby evenly disburse said mercury within said chamber.

2. A method according to claim 1, wherein said uniformly heating said chamber along said length includes heating said chamber to, at or above 225° C.

3. The method according to claim 2, wherein said uniformly heating said chamber along said length includes heating said chamber to between 240° C. and 275° C., inclusive.

4. The method for producing a fast-start fluorescent lamp of claim 3, wherein said uniformly heating said chamber along said length includes heating said chamber to substantially 250° C. for at least 5 minutes.

5. The method according to claim 3, further including;

inserting mercury into a plurality of chambers having a length, said chambers containing phosphor;

securing electrodes to each said chamber of said plurality of chambers;

sealing each said chamber of said plurality of chambers; and uniformly heating each said chamber of said plurality of chambers along said lengths of each said chamber such that no chamber of said plurality of chambers contacts any other chamber of said plurality of chambers while being heated.

6. The method according to claim 5, wherein said uniformly heating each said chamber includes positioning each said chamber on a structure such that each said chamber of said plurality of said chambers are aligned substantially horizontally and spaced apart from each other while being heated.

7. The method according to claim 6, wherein each said chamber has a substantially circular cross-section defining a center and said centers are spaced apart from each other by a defined distance.

8. The method according to claim 7, wherein said defined distance is substantially 5 millimeters.

9. The method according to claim 6, wherein said uniformly heating each said chamber includes a plurality of said structures stacked one on top of the other, and said uniformly heating each said chamber of said plurality of chambers includes inserting said structures into a convection oven.

10. The method according to claim 6, wherein said uniformly heating each said chamber includes positioning said structure on a continuous loop leading through a convection oven.

11. A method of reducing warm-up times of a plurality of assembled and sealed fluorescent lamps, said method comprising:

placing the plurality of assembled lamps on a structure such that each lamp of said plurality are spaced apart from each other by a defined distance; and evenly heating said plurality of lamps in a rack such that mercury in said plurality of said lamps vaporizes and thereby becomes evenly distributed through each said lamp of said plurality of assembled and sealed fluorescent lamps.

12. The method for reducing the warm-up times of a plurality of assembled and sealed fluorescent lamps of claim 11, further including evenly cooling said plurality of lamps.

13. The method for reducing the warm-up times of a plurality of assembled and sealed fluorescent lamps of claim 11, wherein said uniformly heating said chamber along said length includes heating said chamber to, at, or above 225° C.

14. The method for reducing the warm-up times of a plurality of assembled and sealed fluorescent lamps of claim 13, wherein said uniformly heating said plurality of lamps includes heating said plurality of assembled and sealed fluorescent lamps to between 240° C. and 275° C., inclusive.

15. The method for reducing-the warm-up times of a plurality of assembled and sealed fluorescent lamps of claim 11, wherein each said lamp of said plurality of lamps have a pair of lead lines extending therefrom, and said placing the plurality of lamps in a structure includes supporting each lamp of said plurality of lamps in said structure only by said lead lines.

16. The method for reducing the warm-up times of a plurality of assembled and sealed fluorescent lamps of claim 11, wherein said evenly heating said plurality of said lamps in said structure includes inserting said structure into a convection oven.

* * * * *